US006531252B1

(12) United States Patent
Liang et al.

(10) Patent No.: US 6,531,252 B1
(45) Date of Patent: Mar. 11, 2003

(54) METHOD OF MANUFACTURING A MATRIX FOR CATHODE-RAY TUBE

(75) Inventors: Kangning Liang, Lancaster, PA (US); Victoria Ann Rebar, York, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 10/199,569

(22) Filed: Jul. 19, 2002

(51) Int. Cl.[7] ..... H01J 9/20; H01J 29/18

(52) U.S. Cl. ..... 430/25; 430/24; 430/28

(58) Field of Search ..... 430/23, 24, 28, 430/25

(56) References Cited

U.S. PATENT DOCUMENTS 5,108,874 A * 4/1992 Griffing et al. ..... 430/273
6,037,086 A * 3/2000 Gorog et al. ..... 430/25

* cited by examiner

*Primary Examiner*—John A. McPherson
(74) *Attorney, Agent, or Firm*—Joseph S. Tripoli; Carlos M. Herrera; Richard LaPeruta, Jr.

(57) ABSTRACT

A method of manufacturing a luminescent screen assembly for a color cathode-ray tube (CRT) is disclosed. The luminescent screen assembly is formed on an interior surface of a faceplate panel of the CRT. The luminescent screen assembly includes a light-absorbing matrix having a plurality of substantially equally sized openings formed therein. The matrix is formed by applying one or more light sensitive layers on the interior surface of the faceplate panel of the CRT tube. The one or more light sensitive layers includes a photoresist material. Also, the one or more light sensitive layers includes a contrast enhancing material. The one or more light sensitive layers are selectively exposed to actinic radiation projected through openings in a shadow mask, positioned a fixed distance from the screen assembly. The invention involves two set of exposures to the one or more layers: a first dosage which causes selected regions of the contrasting enhancing material to bleach in such a manner that the contrasting enhancing material will behave as a filter for the second dosage, which predominantly causes the photoresist to substantially harden in the select regions. The second dosage is filtered as it propagates in the one or more layers such that the ratio of the level of actinic radiation in selected regions to the level of actinic radiation in non-selected regions is greater than the ratio of the corresponding incident second dosage in the selected regions to the non-selected regions, thereby making it easier to print matrix lines in CRTs having high transmission masks. Thereafter, the matrix lines are formed when matrix material is deposited onto uncovered areas of the screen surface followed by removal of retained portions of the one or more light sensitive layers. When separate layers are used for the photoresist material and the contrast enhancing material, a barrier layer may optionally be interposed therebetween.

12 Claims, 9 Drawing Sheets

METHOD OF MANUFACTURING A MATRIX FOR CATHODE-RAY TUBE

BACKGROUND OF THE INVENTION

1. Field of the Invention

This invention relates to a color cathode-ray tube (CRT) and, more particularly to a color CRT including a luminescent screen assembly.

2. Description of the Background Art

A color cathode-ray tube (CRT) typically includes an electron gun, an aperture mask, and a screen. The aperture mask is interposed between the electron gun and the screen. The screen is located on an inner surface of a faceplate of the CRT tube. The aperture mask functions to direct electron beams generated in the electron gun toward appropriate color-emitting phosphors on the screen of the CRT tube.

The screen may be a luminescent screen. Luminescent screens typically comprise an array of three different color-emitting phosphors (e. g., green, blue, and red). Each color-emitting phosphor is separated one from the other by a matrix line. The matrix lines are formed of a light-absorbing black inert material.

The matrix lines may be deposited on the screen using a shadow mask photolithographic process. In shadow mask photolithographic processes, an image of the aperture mask is formed in a layer of photoresist material coated on the screen, through exposure to ultraviolet (UV) light and resist development in an appropriate developer, providing covered areas and uncovered areas on the screen surface. In a negative photoresist process, covered areas are those areas that are exposed to a substantial dosage of actinic radiation to cause the photoresist to harden and essentially resist developing off of the screen during resist development, while uncovered areas are those where the photoresist is not exposed to an adequate dosage of actinic radiation to cause it to harden and as such the photoresist in the uncovered area will develop off of the screen. For shadow mask lithographic or photoresist processes, the aperture mask is positioned a fixed distance from the screen such that shadows therefrom, projected onto the resist coated screen during exposure to UV light, to define uncovered areas, which will be the intended locations of the matrix lines. After the resist development step, the matrix lines are formed when matrix material is deposited onto uncovered areas of the screen surface.

Conventional aperture masks typically have a transmission of about 18% to about 22%. Recently, in order to increase the color transmission of the screen without increasing the size of the light-emitting phosphors, aperture masks having transmissions of about 40% to about 60% have been incorporated into the color CRT tube. However, the conventional matrix process used for CRTs having the 18% to 22% mask transmission cannot be used in these higher mask transmission CRTs. The reason is that the shadows projected onto the interior faceplate surface from the three conventional source positions (i.e., red, green, and blue source positions) may detrimentally overlap causing misregister of some of the matrix openings with respect to the corresponding electron beams, and in extreme cases matrix lines may not be formed at all (i.e., in cases with higher mask transmissions).

Accordingly, a new method of making the matrix on a luminescent screen is required.

SUMMARY OF THE INVENTION

The present invention relates to a method of manufacturing a luminescent screen assembly for a color cathode-ray tube (CRT) having a high transmission mask. The luminescent screen assembly is formed on an interior surface of a faceplate panel of the CRT. The luminescent screen assembly includes a light-absorbing matrix having a plurality of substantially equally sized openings formed therein. The matrix is formed by applying one or more light sensitive layers consisting of a contrast enhancing material and a photoresist hardener on the interior surface of the faceplate panel of the CRT. The one or more light sensitive layers are selectively exposed to a first dosage of radiation that is actinic to the contrast enhancing material projected through openings in a shadow mask, positioned a fixed distance from the screen assembly. The contrast enhancing material obtains greater optical transmission in response to the first dosage such that higher levels of the first dosage cause greater transmission values, wherein transmission specifically refers to a transmission of the contrast enhancing material to a second dosage of radiation. The second dosage of radiation predominantly causes the photoresist to harden and is applied through the mask such that the second dosage aligns with the first dosage. The effective intensity profile of the second dosage will be enhanced in that the ratio of a higher intensity area to a lower intensity area of the second dosage as it propagates through the contrast enhancing material will be at a higher ratio than the corresponding ratio of the actual incident second dosage. Therefore, the contrast enhancing material enables the manufacturer to more easily achieve the targeted dimensions for the hardened and non-hardened photoresist areas. The one or more light sensitive layers in non-hardened regions are removed in a development step. Opaque matrix material is then deposited on the screen surface, followed by removal of the hardened light sensitive layers forming opaque matrix lines on the interior faceplate.

Alternatively, a photoresist layer along with a separate contrast enhancing layer may be used for the one or more light sensitive layers. Additionally, a barrier layer may be deposited to separate the photoresist layer and contrast enhancing layer.

BRIEF DESCRIPTION OF THE DRAWINGS

The invention will now be described in greater detail, with relation to the accompanying drawings.

DETAILED DESCRIPTION OF THE PREFERRED EMBODIMENT

Figure 1:
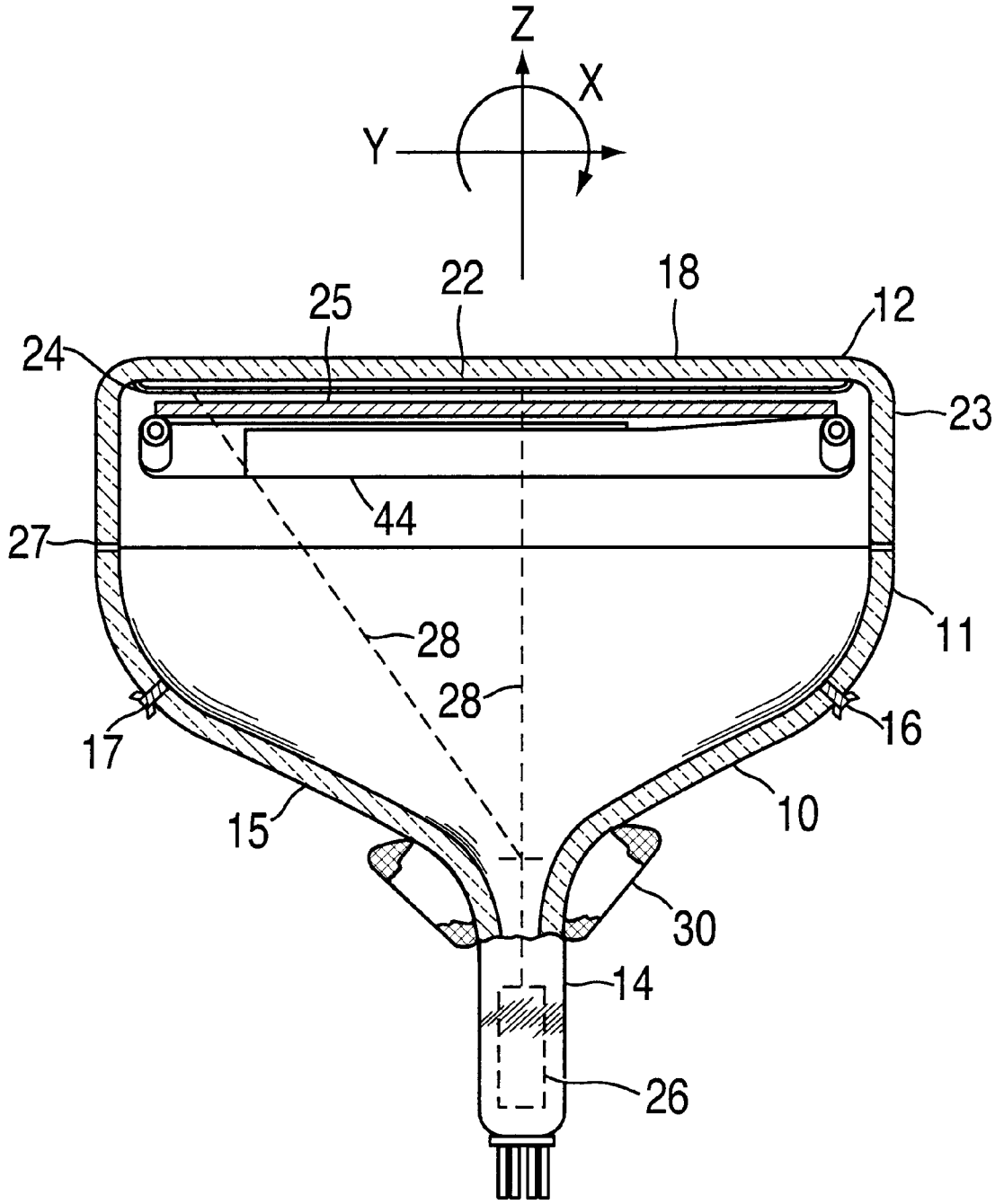
FIG. 1 is a plan view, partly in axial section, of a color cathode-ray tube (CRT) made according to the present invention.

FIG. 1 shows a color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 2:
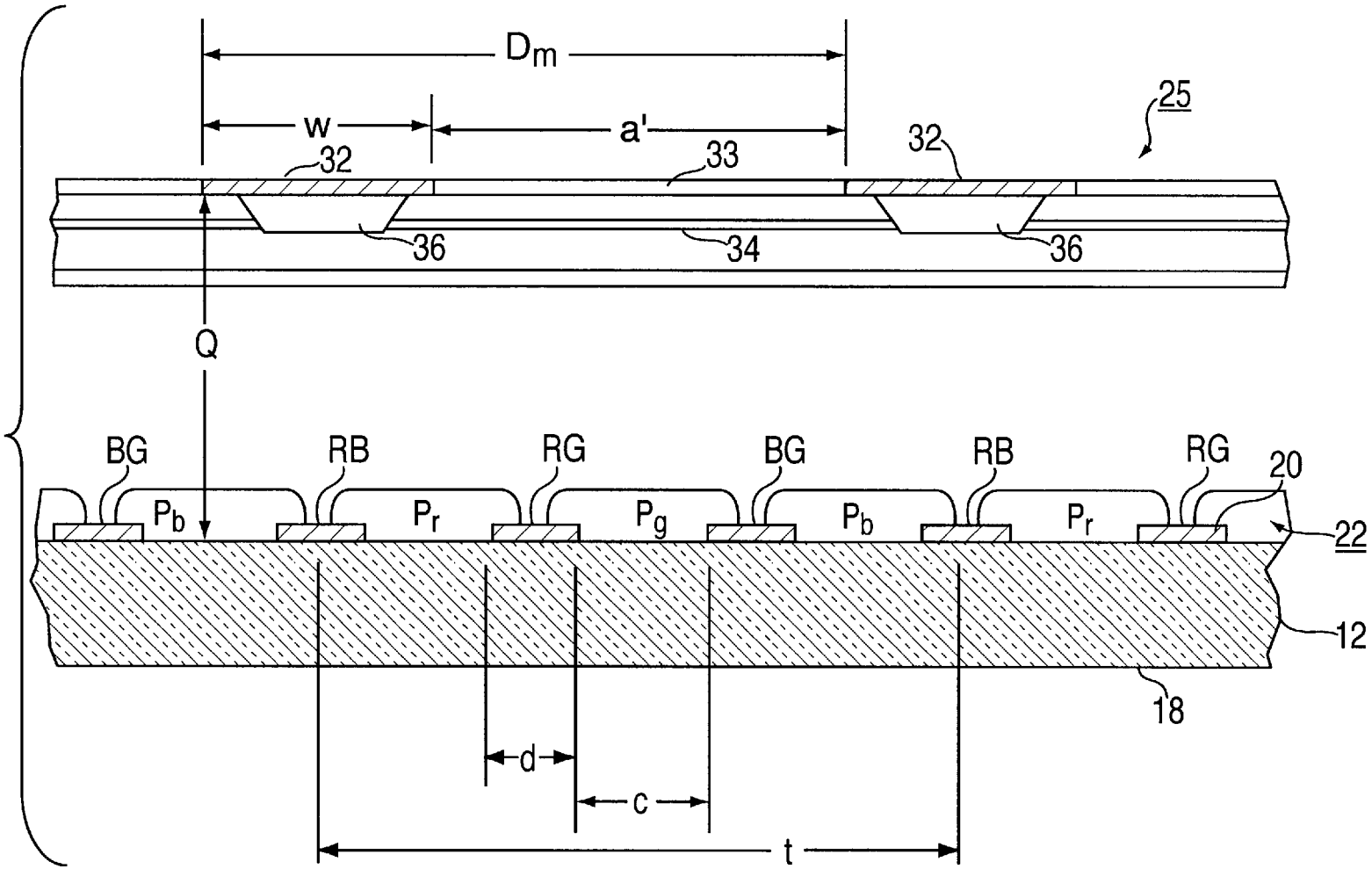
FIG. 2 is a section of a faceplate panel of the CRT of FIG. 1, showing a screen assembly.

The faceplate panel 12 comprises a viewing faceplate 18 and a peripheral flange or sidewall 23 that is sealed to the funnel 15 by a glass frit 27. A three-color luminescent phosphor screen 22 is carried on the inner surface of the faceplate 18. The screen 22, shown in cross-section in FIG. 2, is a line screen which includes a multiplicity of screen elements comprising red-emitting, green-emitting, and blue-emitting phosphor stripes R, G, and B, respectively, arranged in triads, each triad including a phosphor line of each of the three colors. The R, G, B, phosphor stripes extend in a direction that is generally normal to the plane in which the electron beams are generated.

A light-absorbing matrix 20, shown in FIG. 2, separates the phosphor lines. A thin conductive layer 24, preferably of aluminum, overlies the screen 22 and provides means for applying a uniform first anode potential to the screen 22, as well as for reflecting light, emitted from the phosphor elements, through the faceplate 18. The screen 22 and the overlying aluminum layer comprise a screen assembly.

A multi-aperture color selection electrode, or shadow mask 25, is removably mounted, by conventional means, within the faceplate panel 12, in predetermined spaced relation to the screen 22.

An electron gun 26, shown schematically by the dashed lines in FIG. 1, is centrally mounted within the neck 14, to generate and direct three inline electron beams 28, a center and two side or outer beams, along convergent paths through the shadow mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams 28 to magnetic fields that cause the beams to scan a horizontal and vertical rectangular raster across the screen 22.

Figure 3:
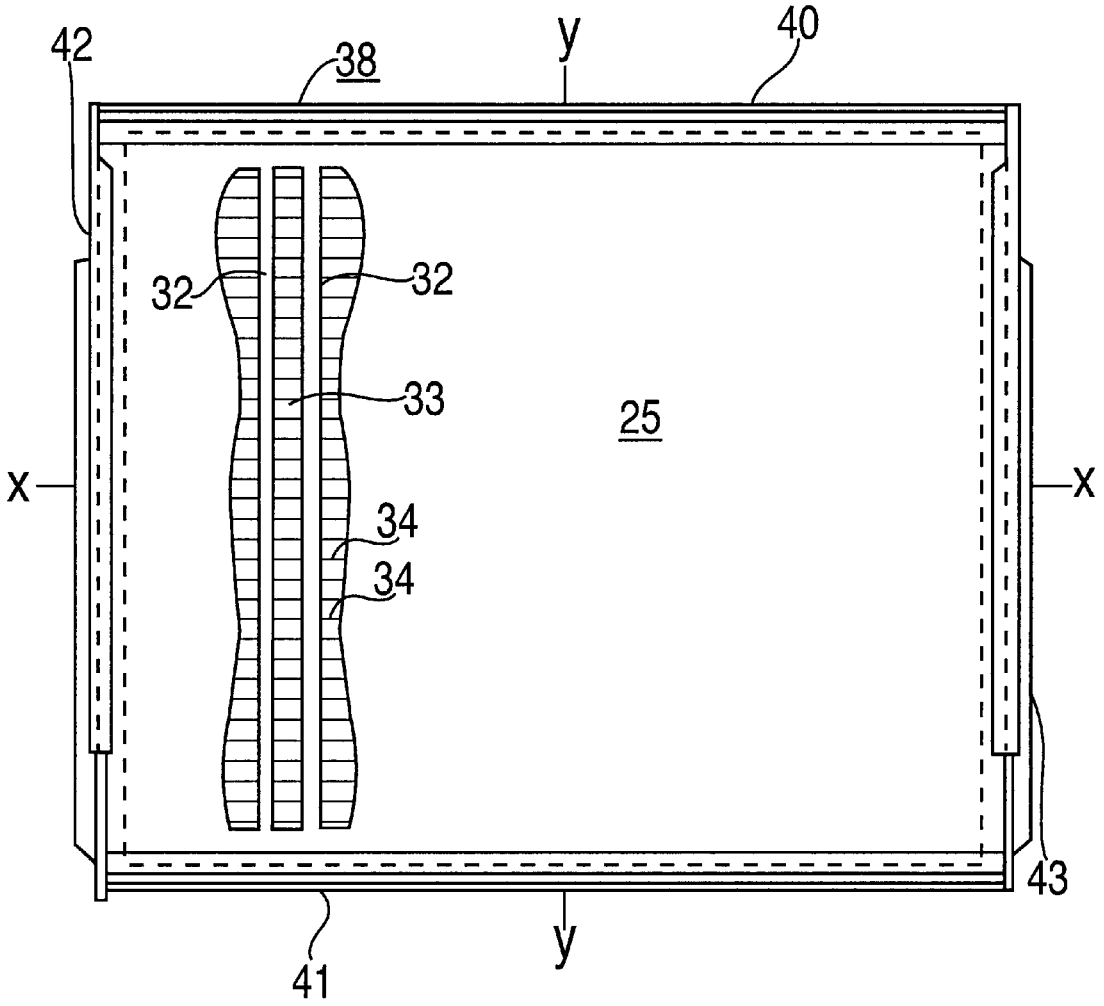
FIG. 3 is a plan view of a tension focus mask and frame used in the CRT of FIG. 1.

As shown in FIG. 3, the shadow mask 25 is formed, preferably, from a thin rectangular sheet of about 0.05 mm (2 mil) thick low carbon steel, that includes two horizontal sides and two vertical sides. The two horizontal sides of the mask 25 parallel the central major axis, X, of the mask and the two vertical sides parallel the central minor axis, Y, of the mask. With reference to FIGS. 2 and 3, the tension focus mask 25 includes an apertured portion that contains a plurality of elongated strands 32 separated by slots 33 that parallel the minor axis, Y, of the mask.

In one configuration, the mask pitch, $D_m$, defined as the transverse dimension of a strand 32 and an adjacent slot 33, is 0.87 mm (34 mils). As shown in FIG. 2, each strand 32 has a transverse dimension, or width, w, of about 0.39 mm (15 mils) and each slot 33 has a width, a', of about 0.48 mm (19 mils). The slots 33 extend from one horizontal side of the tension focus mask to the other horizontal side thereof. A plurality of wires 34, each having a diameter of about 0.025 mm (1 mil), are disposed substantially perpendicular to the strands 32 and are spaced therefrom by insulators 36.

Again with reference to FIG. 2, the screen 22, formed on the viewing faceplate 18, includes the light-absorbing matrix 20 with rectangular openings in which the color-emitting phosphor lines are disposed. The corresponding matrix openings have a width, c, of about 0.18 mm (7 mils). The width, d, of each matrix line is about 0.12 mm (5 mils) and each phosphor triad has a width or screen pitch, t, of about 0.9 mm (36 mils). For this embodiment, the tension focus mask 25 is spaced at a distance, Q, (hereinafter Q-spacing) of about 15.24 mm (600 mils) from the center of the interior surface of the faceplate panel 12. During operation of the CRT 10, the voltage difference between the strands 32 and the wires 33, at an anode voltage of 30 kV, is about 800 volts.

The pitch, $D_m$ of the tension focus mask 25 can be varied. For example, in a second configuration, with a mask pitch of 0.68 mm (27 mils) and a strand width of 0.3 mm (12 mils), each matrix opening has a width, c, of about 0.11 mm (4 mils). For this configuration of the tension focus mask 25, with a center Q-spacing of 11.56 mm (455 mils), the voltage difference between the strands 32 and the wires 33, at an anode voltage of 30 kV, is about 750 volts.

The method of manufacturing the matrix 22 will be described in an embodiment using a tension focus mask 25 with a mask pitch, $D_m$, of 0.68 mm as a photographic master. Initially, the panel 12 is cleaned, as indicated in step 50 of FIG. 4, by washing it with a caustic solution, rinsing it in water, etching it with buffered hydrofluoric acid and rinsing it again with water, as is known in the art.

As indicated in step 52, the interior surface of the viewing faceplate 18 of the panel 12 may be coated with a polyvinyl alcohol (PVA) solution and dried to form a precoat layer (not shown in FIG. 5). Because the chemical composition of the glass faceplate panel 12 may vary somewhat from one glass manufacturer to another, the precoat layer provides a uniform surface condition for the deposition of subsequent materials. The thickness of the precoat layer is on the order of a monolayer.

A contrast enhancing/photoresist solution is overcoated onto the precoat layer and dried to form a contrast enhancing/photoresist layer 56, as indicated in step 58. A suitable contrast enhancing/photoresist solution may comprise about 0.5% by weight of a contrast enhancing agent such as, 2-diazo-1-naphthol-4-sulfonic acid mixed with a photoresist solution comprising polymers such as 1.6% by weight of polyvinyl pyrrolidone (PVP), 0.26% by weight of polyvinyl alcohol (PVA), 0.26% by weight of a cross-linking agent such as 4,4'-diazidostilbene-2,2'-disulfonic acid sodium salt (Hardener #3, commercially available from Fairmount Chemical Company, Inc.), in deionized water. The contrast enhancing diazo compound absorbs light in the range of 330 nm to 430 nm, while the Hardener #3 absorbs light below 390 nm. The contrast enhancing/photoresist layer 56 has a thickness of about 1 $\mu$m.

Figure 5A:
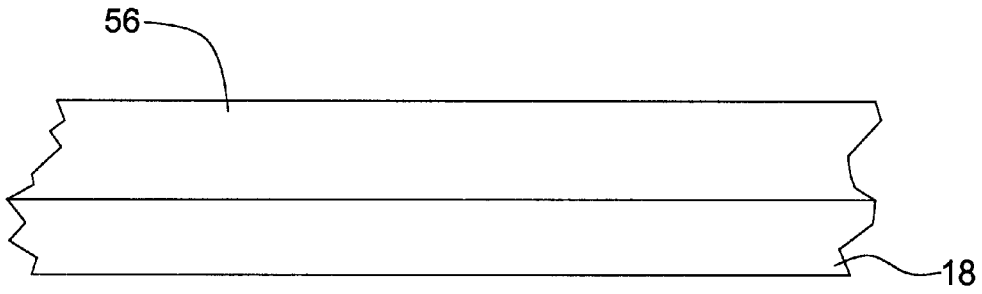
FIGS. 5(*a*)–5(*f*) depict views of the interior surface of the faceplate screen during matrix formation.
Figure 5B:
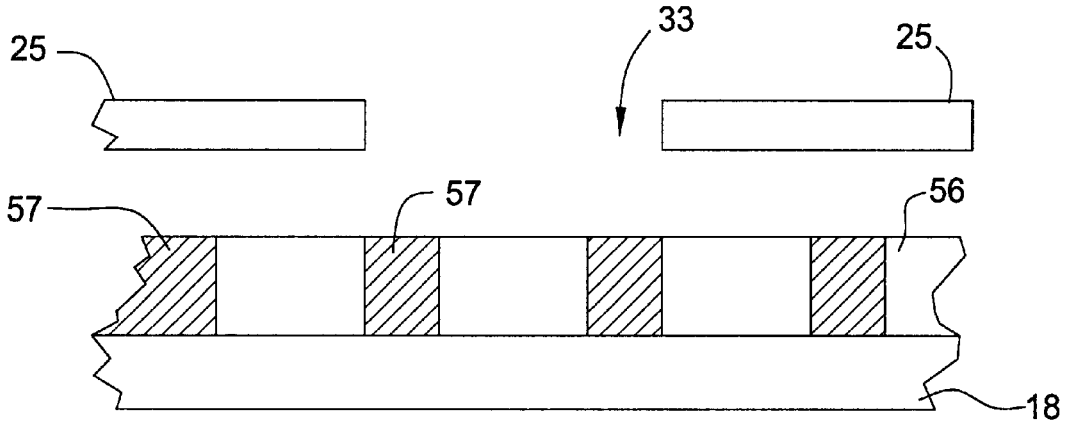
Figure 5C:
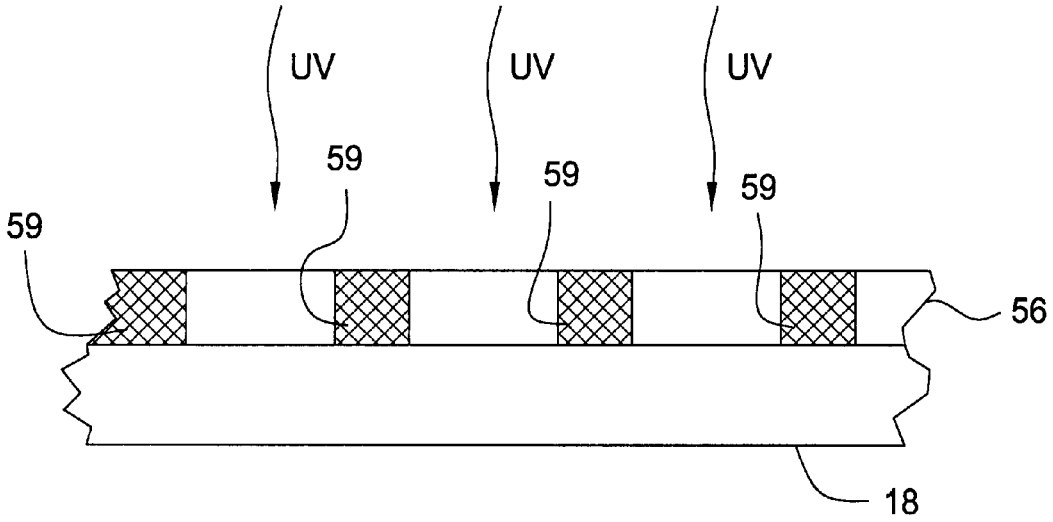

The tension focus mask 25 is inserted into the faceplate panel 12 as shown in FIG. 5*b* and mounted within a lighthouse (not shown), containing a plurality of light sources. Since the focus mask 25 has openings, a', with widths between $D_m/3$ and $2D_m/3$, it is preferred to have the light source positions laterally shifted, either left or right, by a distance, s/2, (where s corresponds to the conventional spacing between light source positions that a manufacturer may use for conventional CRTs) so that the light source, G, no longer lies on the symmetry axis of the screen and the mask. When the light sources are shifted to the right, the mask-screen axis lies halfway between the shifted R and G light sources. Similarly, when the light sources are shifted to the left, the screen symmetry axis lies midway between the shifted G and B light sources. This specific optical configuration is disclosed in U.S. Pat. No. 6,037,086 issued to Gorog et al. on Mar. 14, 2000.

The lateral shift of the light sources required for printing screens for a CRT having a tension focus mask 25 affects only the reference positions of the matrix stripes with respect to the mask openings 33. It has no influence on the stripe-to-stripe spacing, i.e., such shifting of the source does not change the screen structure elements or their relationship to each other, but rather laterally shifts them collectively with respect to the mask.

Figure 4:
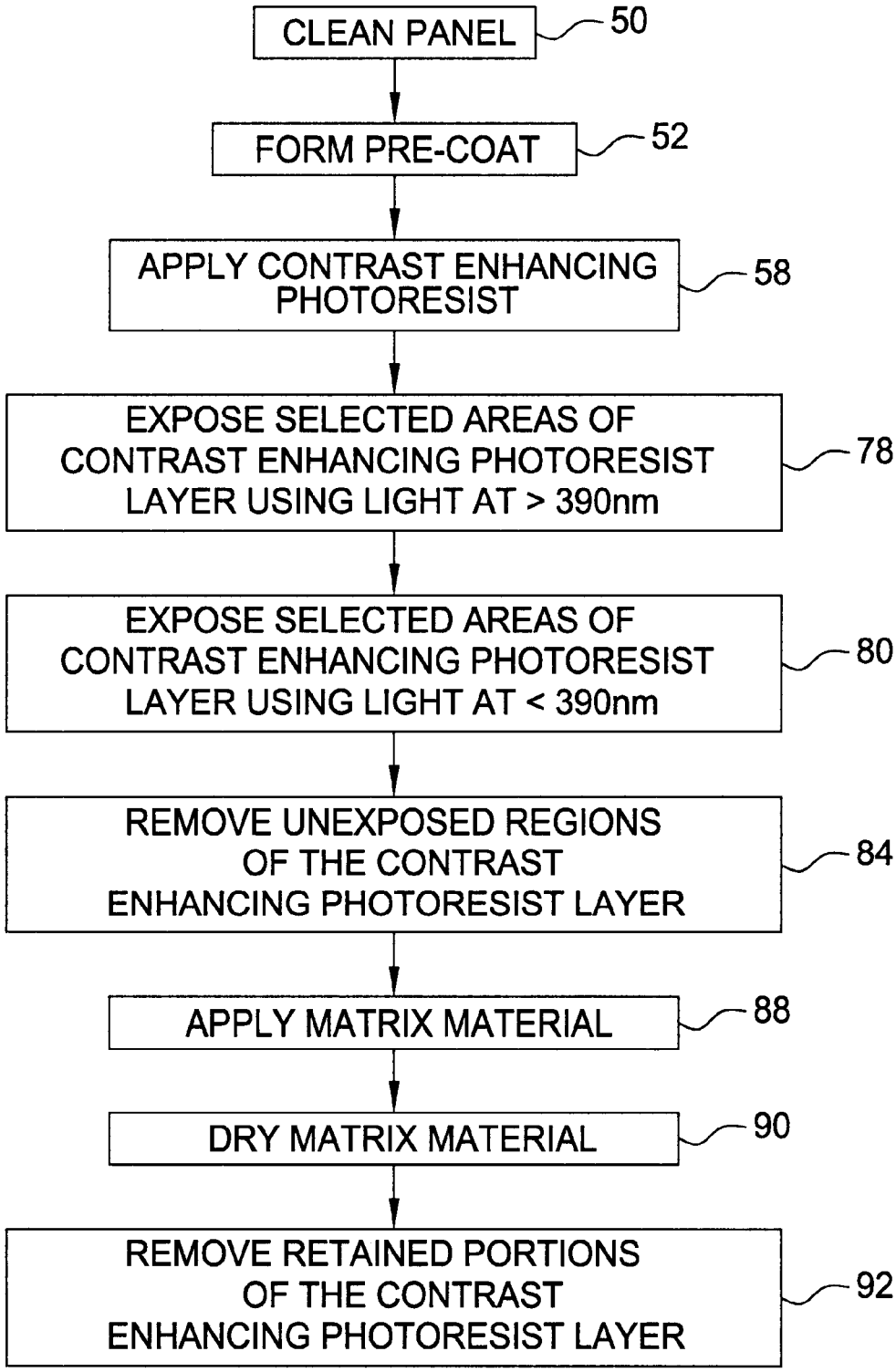
FIG. 4 is a block diagram comprising a flow chart of the manufacturing process for the screen assembly of FIG. 2.

As indicated in step 78 of FIG. 4 and using the procedure described above, the contrast enhancing/photoresist layer was selectively exposed to visible light having wavelengths greater than 390 nm. Such an exposure photochemically decomposes (e. g., bleaches) the contrast enhancing agent, forming a virtual mask having a higher transmission or bleached regions 57 on portions of layer 56 as shown in FIG. 5*b*. This exposure is referred to as the first dosage.

Then, as indicated in step 80, the UV radiation source within the lighthouse exposes selective areas of layer 56 to UV radiation having a wavelength less than about 390 nm. The UV radiation selectively changes the solubility of layer 56 in bleached areas. The non-illuminated areas of layer 56, between the bleached regions, are unaffected by the UV exposure and retain their solubility, while the illuminated areas now become hardened regions 59 of layer 56 and are rendered less soluble. This exposure is referred to as the second dosage.

Figure 5D:
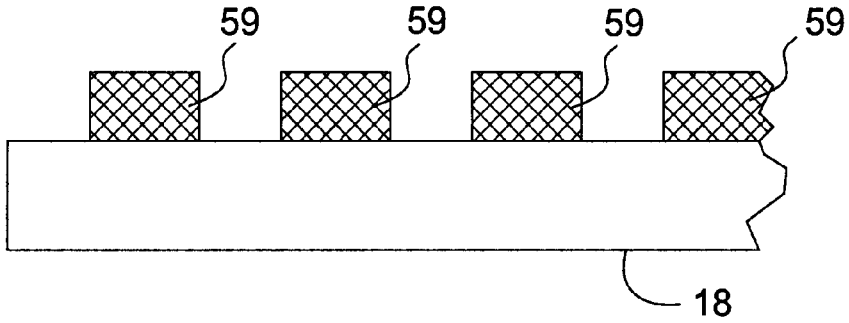

As indicated in step 84 and FIG. 5*d*, the unexposed regions of layer 56 between the bleached areas are removed by rinsing the panel 12 with a suitable solvent, such as for example water. This development step exposes portions of the surface of the panel 12, while leaving intact the hardened areas 59 of layer 56 having lesser solubility.

Figure 5E:
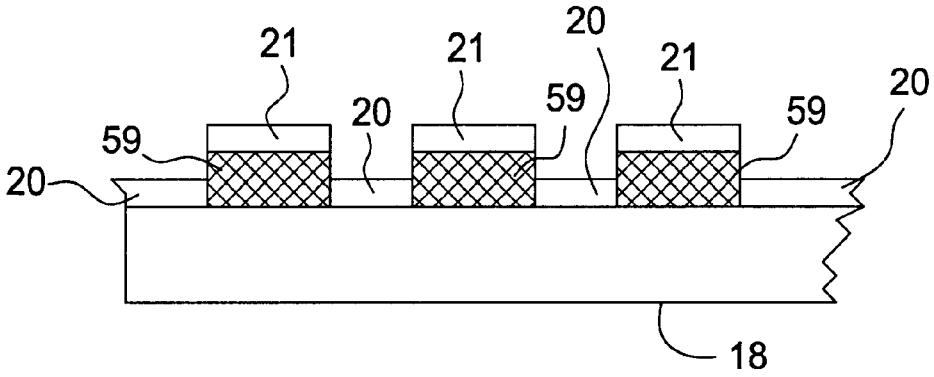
Figure 5F:
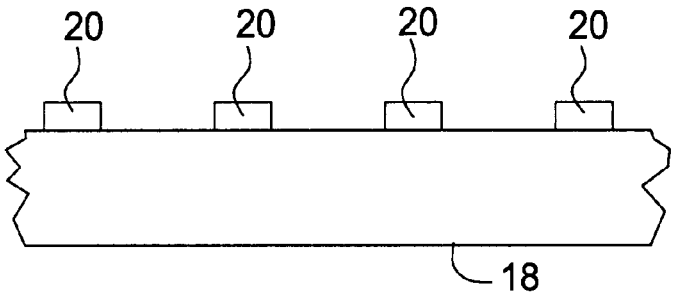
Figure 6A:
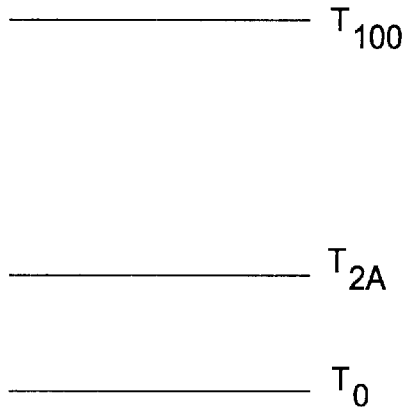
FIGS. 6(*a*)–6(*d*) are drawings showing the influence of the contrast enhancing material on the contrast ratio during the photochemical hardening reaction of the photoresist in the case where the second dosage of light also causes additional photobleaching of the contrast enhancing material.
Figure 6B:
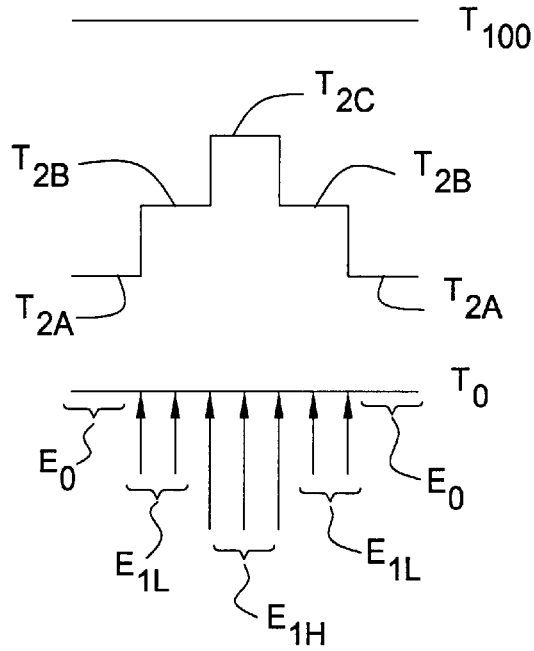
Figure 6C:
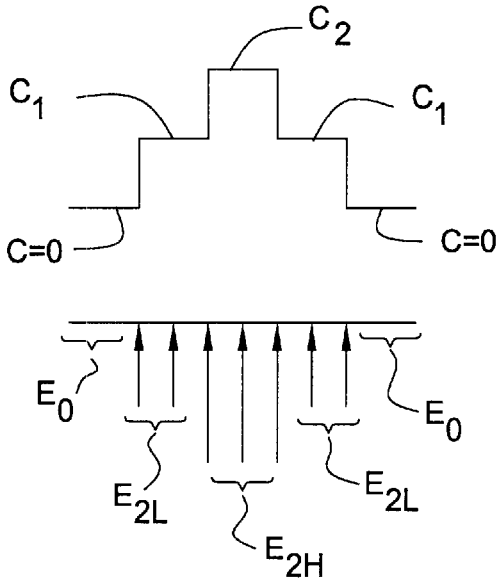
Figure 6D:
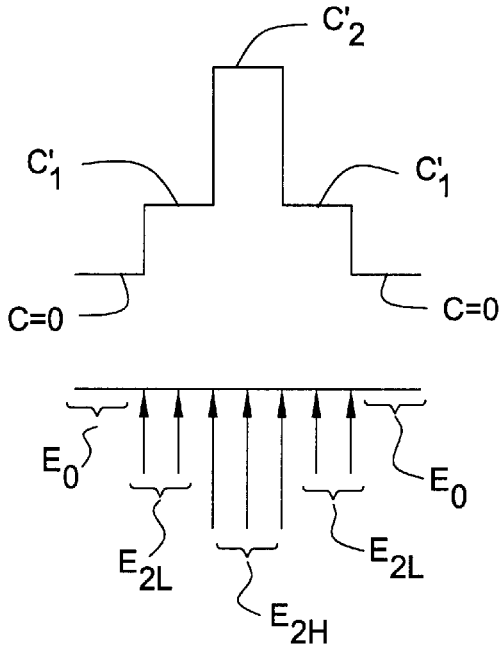
Figure 7A:
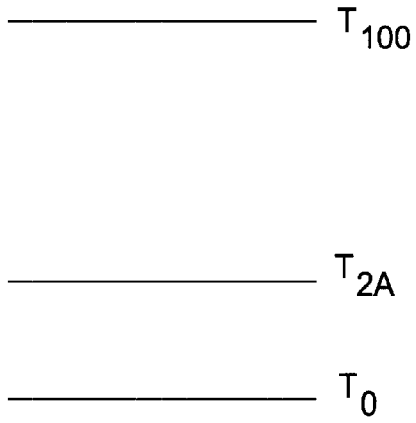
FIGS. 7(*a*)–7(*d*) are drawings showing the influence of the contrast enhancing material on the contrast ratio during the photochemical reaction in the case where the second dosage of light only causes hardening of the photoresist.
Figure 7B:
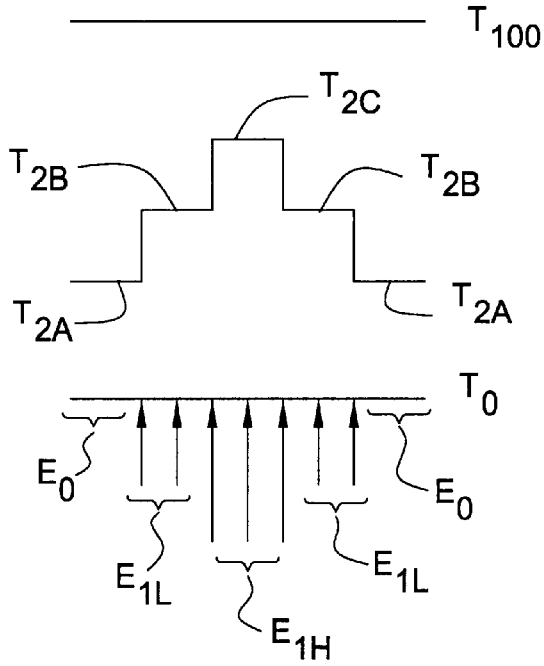
Figure 7C:
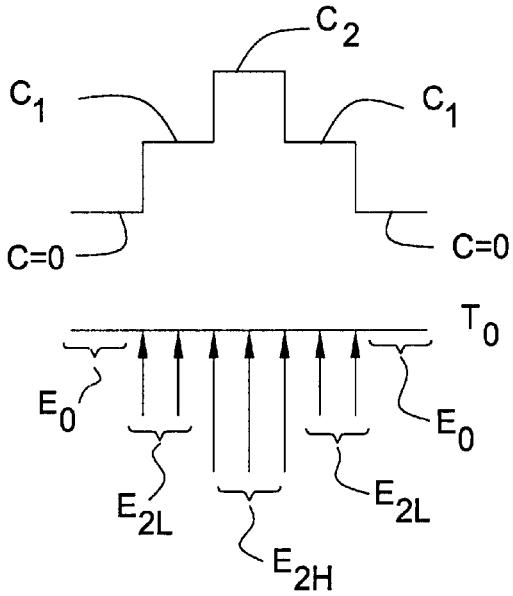
Figure 7D:
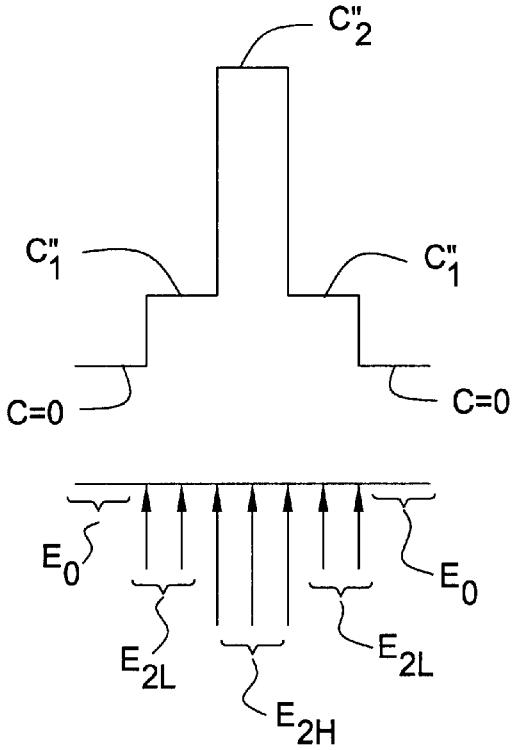

The matrix is formed, as indicated in step 88, by coating the exposed portions of the surface of the panel 12 as well as the retained hardened areas 59 of layer 56, having lesser solubility, with an aqueous graphite suspension as shown in FIG. 5*e*. The suspension is dried to form a light-absorbing matrix 20, as indicated in step 90, and developed, in step 92, by depositing a suitable solvent, such as aqueous periodic acid, or the equivalent, onto the matrix to soften and swell the underlying retained areas of layer 56 having lesser solubility. The matrix is then flushed with water to remove the loosened, less soluble, retained hardened areas 59 of layer 56, forming openings therein, but leaving the matrix lines attached to the exposed portions of the interior surface of the panel 12 as shown in FIG. 5*f*. FIG. 5*e* shows the portion 21 of the light-absorbing graphite which formed on the retained hardened areas 59 of layer 56 and was also subsequently removed with retained hardened areas 59 during step 92. While the contrast enhancing/photoresist layer 56 has been described herein as a single layer, it is within the scope of this invention to use a separate contrast enhancing layer (CEL) along with a separate photoresist layer. Suitable CEL materials include mixtures of 2,5-dibutoxy-4-(4-morpholinyl)benzenediazonium tetrafluoroborate (Diazo 55), polyvinylpyrrolidone (PVP), and phenol dissolved in methyl ethyl ketone (MEK). In this case, the virtual mask can be fixed by converting the unreacted Diazo 55 into a diazo dye in an ammonia atmosphere. Alternatively, polyvinyl methyl ether (PVME) or poly(2-ethyl-2-oxazoline) (PEOX) may be substituted for the PVP. Also, 2-diazo-1-naphthol-5-sulfoester with 2,4-dihydroxybenzophenone (ANS-DHB) may substitute the Diazo 55 as the contrast enhancing agent in the CEL mixture. Other materials which can substitute the Diazo 55 include 2-diazo-1-naphthol-5-sulfo ester with 2,3,4-trihydroxy benzophenone and 2-diazo-1-naphthol-5-sulfo ester with tetrahydroxy benzophenone.

Typical thicknesses for the separate CEL and photoresist layers are about 6 $\mu$m and 1.5 $\mu$m, respectively.

Since the photoresist is soluble in water, nonpolar solvents (e. g., methyl ethyl ketone (MEK), methyl isobutyl ketone (MIBK), toluene) should preferably be used for the CEL mixture when separate layers are used for the CEL and the photoresist. Additionally, a barrier layer may be interposed between the CEL and the photoresist to minimize intermixing thereof. Suitable barrier layers include polyethylene oxide (PEO) and polyvinylmethyl ether (PVME) dissolved in toluene. The barrier layer may have a thickness of about 2 $\mu$m.

To more clearly show the advantage of the invention, FIGS. 6 and 7 are provided. FIGS. 6 and 7 demonstrate examples where the contrast enhancement material is characterized by having a transmission $T_{2a}$ for the wavelengths of light contained in the second dosage (i.e., actinic light for the photoresist hardening) prior to any exposure of the contrast enhancing material to wavelengths of light of the first dosage (i.e., actinic for the photobleaching of the contrast enhancement material). FIG. 7 is the example where (1) the incident first dosage only contains wavelengths of light which are actinic toward photobleaching the contrast enhancing material and (2) the incident second dosage only contains wavelengths of light which are actinic toward hardening the photoresist. $T_0$ corresponds to a transmission value of 0%. FIG. 7*b* shows the transmission profile of the contrast enhancing material after being photobleached by the first dosage. The arrows $E_{1H}$ and $E_{1L}$ correspond to energy of the first dosage of light striking the respective lateral locations of the contrast enhancing material, wherein $E_{1H}$ is a higher level of energy than $E_{1L}$ and $E_0$ corresponds to energy impinging the contrast enhancing material in the respective lateral location. FIG. 7*b* further shows that $E_{1H}$ and $E_{1L}$ cause the contrast enhancing material to have transmission values of $T_{2C}$ and $T_{2B}$, respectively, wherein $T_{100}>T_{2C}>T_{2B}>T_{2A}>T_0$. FIGS. 7*c* and 7*d* further go on to show the level of hardening that occurs in the photoresist when the second dosage of light must also propagate through the contrast enhancing material. In these figures, the arrows $E_{2H}$, $E_{2L}$, and $E_0$ correlate to energy levels of the second dosage of light in the respective lateral locations, wherein $E_{2H}>E_{2L}>E_0$ and $E_0=0$. FIG. 7*c* is the instance where the second dosage propagates through the contrast enhancing material and the photoresist when the contrast enhancing material has not been exposed to the first dosage and has a transmission $T_{2A}$ to the second dosage. FIG. 7*c* further shows that hardening levels of the photoresist as being $C_2$, $C_1$, and $C_0$, wherein $C_2$, $C_1$, and $C_0$ correspond to locations receiving $E_{2H}$, $E_{2L}$, and $E_0$, respectively, and $C_2>C_1>C_0$ with $C_0$ corresponding to no photochemical hardening. FIG. 7*d*, on the other hand, shows the hardening level of the photoresist the same incident energy profile of the second dosage as in FIG. 7*c*, but the contrast enhancing material has been previously photobleached by a first dosage as in FIG. 7*b*. FIG. 7*d* shows that hardening levels of the photoresist as being $C''_2$, $C''_1$, and $C_0$, wherein $C''_2$, $C''_1$, and $C_0$ correspond to locations receiving $E_{2H}$, $E_{2L}$, and $E_0$, respectively, and $C''_2>C''_1>C_0$. Inspection of the FIGS. 7*c* and 7*d* shows that $C''_2>C_2$, $C''_1>C_1$, and $C''_2/C''_1>C_2/C_1$. The last relationship, $C''_2/C''_1>C_2/C_1$, shows how the contrast enhancing materials selectively enhance the contrast ratio of hardening of the photoresist to second dosages in a disproportionate and advantage manner when the material had previously been exposed to a first dosage of light. Essentially, the level of hardening of the photoresist from the second dosage energy level $E_{2H}$ is enhanced substantially more so in the region designated with a transmission $T_{2C}$ than the location having the transmission $T_{2B}$ for $E_{2L}$ because $T_{2C}>T_{2B}$ and $E_{2H}>E_{2L}$, thereby causing an exponential enhancement of contrast ratio $C''_2/C''_1$. It should be pointed out that FIG. 7 also represents the case where the transmission of the contrast enhancing material has been fixed before exposure by the second dosage, regardless of whether the second dosage would cause additional bleaching of the contrast enhancing material in an unfixed state.

FIG. 6 is the example where (1) the incident first dosage only contains wavelengths of light which are actinic toward photobleaching the contrast enhancing material and (2) the incident second dosage predominantly contains wavelengths of light which are actinic toward hardening the photoresist and some smaller portion which causes some additional photobleaching to the contrast enhancing material. In this example, FIGS. 6(*a*), 6(*b*), and 6(*c*) are the same as those in FIGS. 7(*a*), 7(*b*), and 7(*c*); however, FIG. 6(*d*) shows the result of having the second dosage with some overlapping of actinic properties. Essentially what is shown is that the hardening levels of the photoresist as being $C'_2$, $C'_1$, and $C_0$, wherein $C'_2$, $C'_1$, and $C_0$ correspond to locations receiving $E_{2H}$, $E_{2L}$, and $E_0$, respectively, and $C'_2>C'_1>C_0$ with $C_0$ corresponding to no photochemical hardening. However, $C'_2$ is smaller than $C_2''$of FIG. 7(*d*) because as the second dosage is being applied and causes hardening of the photoresist, some minor portion of the second dosage continues to cause the contrast enhancing material to be further photobleached, thereby permitting more of the second dosage to transmit and harden the photoresist; however, the portion of the contrast enhancing material having transmission $T_{2B}$ in FIG. 6*b* will be more transmissive at a faster rate than that of the location having transmission $T_{2C}$. FIGS. 6(*c*) and 6(*d*) show $C'_1>C_1$ because, as in FIGS. 7(*c*) and 7(*d*), the lower energy level $E_{1L}$ of the first dosage was only incident on the contrast enhancing layer in the case of $C'_1$ and, as such, the second exposure is only confronted with the transmission $T_{2B}$, as opposed to the case in FIG. 6(*c*), where the second dosage is confronted the lower transmission $T_{2A}$. Inspection of FIG. 7(*d*) and FIG. 6(*d*) show that $C''_2/C''_1>C'_2/C'_1$ suggesting that the preferred embodiment in the cases where the contrast enhancing material is either fixed before the second dosage or the second dosage only has wavelengths of light which do not cause additional photobleaching.

Figure 8:
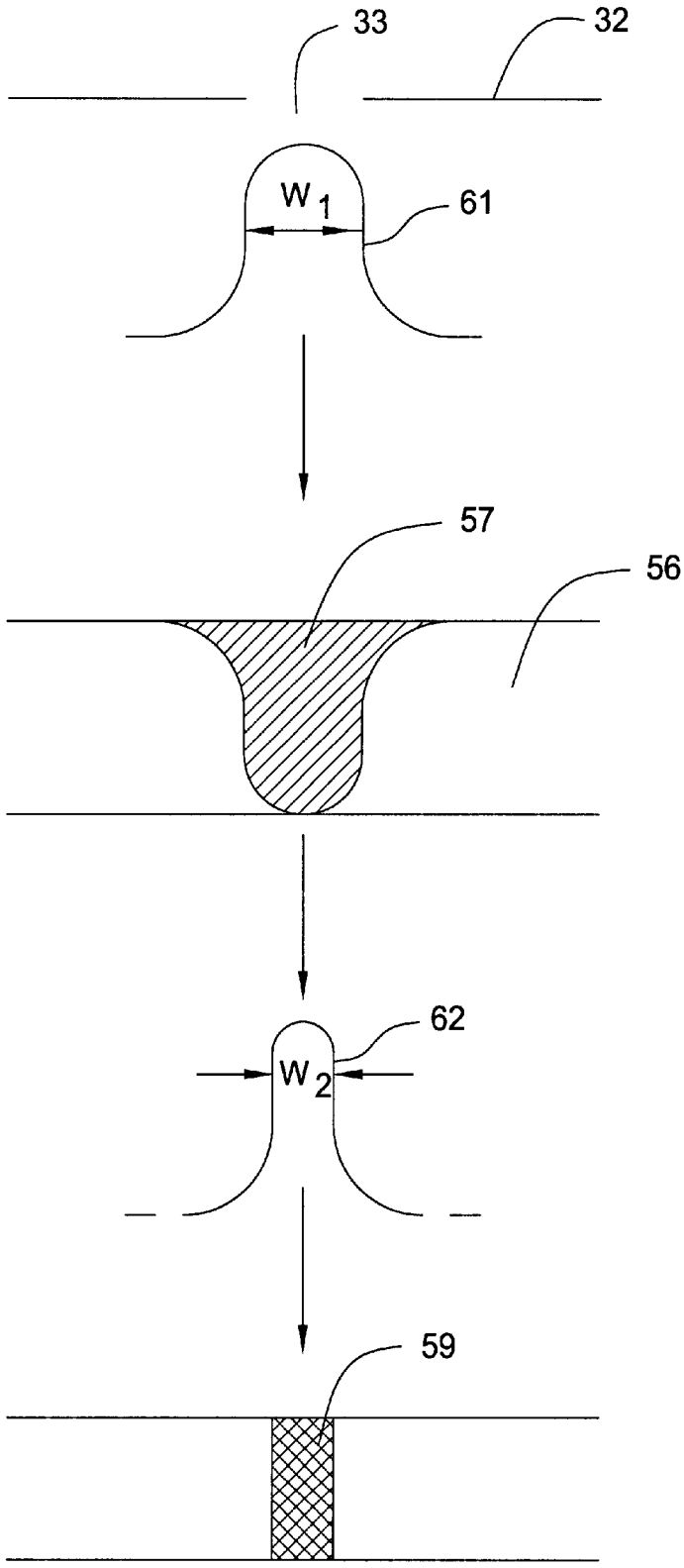
FIG. 8 is a schematic flow chart of the process showing the photobleaching profile of the first dosage and the transmission profile of the second dosage.

FIG. 8 is another schematic representation of the invention when the contrast enhancing material and the photoresist are in the same layer 56. The intensity profile of the first dosage after passing through the mask slots 33 and incident on the layer is represented by a first profile curve 61 having a first full width at half maximum of $w_1$. The first dosage causes bleaching of the contrast enhancing material which is depicted as the bleached region 57. A second profile curve 62 represents the actual filtered light of the second dosage within the layer 56 that causes the photochemical hardening to the photoresist and results in hardened area 59. (It is important to note that the profile of the second dosage incident on the layer 56 is substantially similar to that of the first profile curve 61.) The second profile curve 62 has a full width at half maximum of $w_2$, wherein $w_2<w_1$ and $w_2$ approximates the width of the hardened area 59. FIG. 8, therefore, shows the advantage of the invention in that it provides the means of obtaining a narrower hardened area 59 than would had otherwise been created with no contrast enhancing material. The application of the actinic light of the second dosage in an equivalent system having no contrast enhance material would generate a wider hardened area that approximates $w_1$.

The following example is provided to further describe the invention. In this example, the first curve 61 of the first dosage (1) has 60 energy units at location $x_1$ which causes layer 56 to have a transmission of 75% at $x_1$, for the second dosage and (2) has 40 energy units at location $x_2$ which causes layer 56 to have a transmission of 40% at $x_2$ for the second dosage. The second dosage will have a substantially similar profile incident on the layer 56, thus if the level of actinic light is 600 energy units at location at $x_1$, the level will be 400 energy units at $x_2$. Thus, at location $x_1$, as 600 energy units of the second dosage strikes the surface of the layer 56, the second dosage is filtered to provide approximately 450 energy units (i.e., transmission 75% multipled by 600 energy units) of light to effect higher level of hardening. However, simultaneously at location $x_2$, with 400 energy units striking the surface of the layer 56, the second dosage is filtered to provide about 160 energy units (i.e., transmission 40% multiplied by 400 energy units) to cause some lower level of hardening. Therefore, the contrast ratio of the effective second dosage causing hardening between locations $x_1$ and $x_2$ is about 2.8(450 energy units/160 energy units), while in an example having no contrast enhancing material, the respective contrast ratio is only 1.5 (600 energy units/400 energy units).

It can be understood by those skilled in the art that the advantages of the invention are not limited to focus tension masks with high transmissions. The invention may also be utilized in other systems wherein some contrast enhancement is sought to tailor the intensity profile of a subsequent dosage of actinic radiation to some photochemically sensitive material.

What is claimed is:

1. A method of manufacturing a light-absorbing matrix for a CRT, said matrix being formed on an interior surface of a faceplate panel of said CRT, said matrix defining openings for the subsequent deposit of phosphor elements, said CRT including a color selection electrode spaced from said interior surface, said electrode having a plurality of slots therein, said method comprising the steps of:

forming at least one light sensitive layer on said interior surface of the said panel, said layer containing a contrast enhancing material and a photoresist material;

exposing said at least one light sensitive layer to a first dosage of light through the slots in said mask sufficiently to selectively bleach the contrast enhancing material causing said material to obtain greater optical transmissions in response to said first dosage such that higher levels of the first dosage cause greater optical transmission, said contrast enhancing material at at least two locations having different optical transmissions, wherein a first location has a lower transmission and a second location has a higher transmission;

exposing said at least one light sensitive layer to a second dosage of light to substantially harden said photoresist material in selected regions, wherein the degree of hardening increases with increasing level of energy of said second exposure, said second dosage having an incident energy profile substantially similar to that of said first dosage, and said incident energy profile being filtered to an effective energy profile which actually dictates the degree of said hardening, wherein said hardening that occurs in said second location is greater than in said first location such that the ratio of said hardening in said second location to said first location is a value that is larger than the ratio would have otherwise been in the absence of said contrast enhancing material;

removing portions of said at least one light sensitive layer that were not substantially hardened by said second dosage and leaving behind said hardened selected regions;

overcoating the interior surface of the faceplate panel with a light-absorbing matrix material; and removing retained portions to form openings where said retained portions were located.

2. The method of claim 1 wherein only one light sensitive layer is formed in the forming step and said one light absorbing layer includes said contrast enhancing material and said photoresist material.

3. The method of claim 2 wherein the contrast enhancing material is a photobleachable diazonium compound selected from the group consisting of 2-diazo-1-naphthol-4-sulfonic acid, 1-diazo-2-naphthol-4-sulfonic acid.

4. The method of claim 2 wherein said photoresist material comprises a mixture of polyvinyl pyrrolidone (PVP), polyvinyl alcohol (PVA), and 4,4'-diazidostilbene-2,2'-disulfonic acid sodium salt (Hardener #3).

5. The method of claim 1 wherein the contrast enhancing material is a photobleachable dye in a water soluable polymer selected from the group of polyvinylpyrrolidone (PVP), polyvinyl methyl ether (PVME) and poly(2-ethyl-2-oxazoline) (PEOX).

6. The method of claim 1 wherein the photoresist material comprises a mixture of polyvinyl pyrrolidone (PVP), polyvinyl alcohol (PVA), and 4,4'-diazidostilbene-2,2'-disulfonic acid sodium salt (Hardener #3).

7. The method of claim 1 wherein two light sensitive layers are formed in the forming step.

8. The method of claim 7 wherein one light sensitive layer contains said contrast enhancing material and the other light sensitive layer contains said photoresist material.

9. The method of claim 8 wherein the contrast enhancing material is a photobleachable diazonium compound selected from the group consisting of, 2,5-Dibutoxy-4-(4-morpholinyl)benzenediazonium tetrafluoroborate (Diazo 55), 2-diazo-1-naphthol-5-sulfo ester with 2,4-dihydroxybenzophenone (ANS-DHB), 2-diazo-1-naphthol-5-sulfo ester with 2,3,4-trihydroxy benzophenone, and 2-diazo-1-naphthol-5-sulfo ester with tetrahydroxy benzopheone.

10. The method of claim 7 wherein a barrier layer is formed between said two light sensitive layers in the forming step and said barrier layer comprises a polymer soluble in an organic solvent and water.

11. The method of claim 10 wherein the polymer is polyethylene oxide (PEO) or polyvinylmethyl ether (PVME).

12. The method of claim 11 wherein the organic solvent is toluene or xylene.

* * * * *